US009554643B2

(12) United States Patent
Nelson et al.

(10) Patent No.: US 9,554,643 B2
(45) Date of Patent: Jan. 31, 2017

(54) HEIGHT ADJUSTABLE SUPPORT TRAY APPARATUS

(71) Applicants: Lauri Nelson, Orlando, FL (US); Danica Smith, Orlando, FL (US)

(72) Inventors: Lauri Nelson, Orlando, FL (US); Danica Smith, Orlando, FL (US)

( * ) Notice: Subject to any disclaimer, the term of this patent is extended or adjusted under 35 U.S.C. 154(b) by 0 days.

(21) Appl. No.: 14/729,051

(22) Filed: Jun. 2, 2015

(65) Prior Publication Data

US 2016/0353878 A1 Dec. 8, 2016

(51) Int. Cl.

| | |
|---|---|
| ***A47B 23/00*** | (2006.01) |
| ***A47B 5/06*** | (2006.01) |
| ***A47B 9/20*** | (2006.01) |
| ***A47B 5/04*** | (2006.01) |
| ***A47B 5/02*** | (2006.01) |

(52) U.S. Cl.

CPC . *A47B 5/06* (2013.01); *A47B 5/02* (2013.01); *A47B 5/04* (2013.01); *A47B 9/20* (2013.01)

(58) Field of Classification Search

CPC ..... A47B 96/02; A47B 96/16; A47B 96/022; A47B 31/06; A47B 31/007; A47B 5/00; D06F 81/06

USPC ..... 108/42, 48, 44, 46, 47

See application file for complete search history.

(56) References Cited

U.S. PATENT DOCUMENTS 1,534,095 A 5/1924 Walker
1,730,790 A 10/1929 Squires
1,759,878 A * 5/1930 Zizzo ..... B60N 2/3011 108/134
2,471,730 A * 5/1949 Doerr ..... B60N 3/001 108/33
2,721,777 A * 10/1955 Willis ..... B60N 3/001 108/44
2,784,004 A * 3/1957 Hamrick, Jr. ..... B62B 1/12 108/48
2,833,608 A * 5/1958 Tobias ..... B60N 3/001 108/44
2,888,761 A 6/1959 Miller
3,057,670 A * 10/1962 Russo ..... A47B 85/04 108/132
3,125,040 A 11/1962 Roberson
3,709,159 A * 1/1973 Oglesby, Jr. ..... A47B 23/041 108/129
3,881,267 A 5/1975 Hicks
(Continued)

*Primary Examiner* — Jose V Chen

(74) *Attorney, Agent, or Firm* — The Patent Guild, Inc.; Paul Royal

(57) ABSTRACT

The present apparatus relates generally to a height adjustable support tray apparatus and accessories, and more particularly to an improved height adjustable support tray apparatus to provide a portable working surface. Particularly the instant apparatus includes a unique attaching section which securely attaches the instant apparatus to the selected support structure. The instant apparatus, when attached to the applicable support structure, provides a broadly useable working surface on which to support various items. The instant apparatus includes a variety of repositioning elements thereby allowing users a multitude of adjustments of the angle and position of the working surface. The instant apparatus also includes support elements which greatly increases the load carrying capacity of the working surface over minimally supported or non-supported working services.

10 Claims, 9 Drawing Sheets

(56) References Cited

U.S. PATENT DOCUMENTS

| | | | | | |
|---|---|---|---|---|---|
| 3,894,496 | A * | 7/1975 | Phillips | A47C 7/68 | 108/50.11 |
| 4,313,385 | A * | 2/1982 | Fitzgerald | A47B 5/06 | 108/38 |
| 4,452,151 | A * | 6/1984 | Jarrard | B60R 5/04 | 108/42 |
| 4,494,465 | A * | 1/1985 | Fick, Jr. | A47B 3/083 | 108/131 |
| 4,496,058 | A | 1/1985 | Harris | | |
| 4,830,243 | A * | 5/1989 | Mann | A61H 3/00 | 108/44 |
| 4,917,130 | A | 4/1990 | Sweder | | |
| 5,004,252 | A | 4/1991 | Kraper | | |
| 5,158,023 | A * | 10/1992 | Allen | E06C 7/14 | 108/42 |
| 5,263,423 | A | 11/1993 | Anderson | | |
| 5,437,367 | A | 8/1995 | Martin | | |
| 5,730,066 | A * | 3/1998 | Auten | B60N 3/001 | 108/44 |
| 5,918,550 | A * | 7/1999 | Weir | A47B 5/06 | 108/152 |
| 6,026,601 | A * | 2/2000 | Kiel | A47B 5/00 | 108/47 |
| 6,123,309 | A | 9/2000 | Sage | | |
| 6,336,412 | B2 * | 1/2002 | Heimbrock | 108/42 | |
| 6,604,472 | B2 | 8/2003 | McNeil | | |
| 6,736,073 | B2 | 5/2004 | Ryburg | | |
| 6,944,981 | B1 | 9/2005 | Garberg | | |
| 7,210,414 | B1 | 5/2007 | Barone | | |
| 7,219,822 | B2 | 5/2007 | Chretien | | |
| 7,364,129 | B1 | 4/2008 | Levari | | |
| 7,415,932 | B1 | 8/2008 | Ngo | | |
| 7,946,609 | B2 * | 5/2011 | Johnson | A45C 5/14 | 280/47.19 |
| 7,966,950 | B2 * | 6/2011 | Volpe, Jr. | B60N 3/002 | 108/115 |
| 7,987,955 | B2 | 8/2011 | Puchalski | | |
| 8,485,327 | B1 | 7/2013 | Dalrymple | | |
| 2001/0050033 | A1 * | 12/2001 | Heimbrock | A61G 13/12 | 108/42 |
| 2004/0083930 | A1 | 5/2004 | Han | | |
| 2004/0226791 | A1 | 11/2004 | Levy | | |
| 2005/0098402 | A1 | 5/2005 | Cohen | | |
| 2008/0134946 | A1 | 6/2008 | Alonso et al. | | |
| 2010/0187063 | A1 | 7/2010 | Sperry | | |
| 2010/0236884 | A1 | 9/2010 | Brown | | |
| 2012/0325607 | A1 | 12/2012 | Webster et al. | | |
| 2013/0032443 | A1 | 2/2013 | Soedomo | | |
| 2013/0153351 | A1 | 6/2013 | House | | |

* cited by examiner

HEIGHT ADJUSTABLE SUPPORT TRAY APPARATUS

FIELD OF THE APPARATUS

The present apparatus relates generally to a height adjustable support tray apparatus and accessories, and more particularly to an improved height adjustable support tray apparatus to provide a portable working surface.

BACKGROUND OF THE INVENTION

Travelling workers often require a portable working surface on which to support various items such as testing and diagnostic equipment, programmer, computers, writing utensils, tools, medicine, books, lamp, multimedia components, personal items, food and beverages, etc.

Often work sites provide limited working space accommodations which may not include the working surface needed by the travelling worker. In route to and from the work site travelling workers must navigate a myriad of logistical obstacles such as lifting and carry cumbrous items, negotiating security screening areas, and setting up and dismantling their own work equipment. Travelling workers must therefore provide their own working surfaces while limiting their transportation and logistics burdens.

It is understood similar burdens are faced by a broad cross-section of users who need a portable working surface on which to support various items, including students, vendors, families, individuals, groups, corporations etc.

U.S. Pat. No. 1,534,095 to Walker discloses a tray and support therefor.

U.S. Pat. No. 3,125,040 to Roberson discloses a car tray.

U.S. Pat. No. 6,604,472 to McNeil discloses a laptop computer support table.

U.S. Pat. No. 6,736,073 to Ryburg discloses a work surface for luggage and luggage carriers.

U.S. Pat. Application Pub No. 20040226791 A1 to Levy discloses a convertible laptop PC bag to workstation with legs.

U.S. Pat. Application Pub No. 20080134946 A1 to Alonso discloses a removable table top attached to a rolling container and method of attaching the table top.

U.S. Pat. Application Pub No. 20100236884 A1 to Brown discloses a luggage table.

U.S. Pat. Application Pub No. 20120325607 A1 to Webster et al. discloses a transport device having a convertible work surface.

Reference to, and discussion of, the foregoing patents is intended to aid in discharging Applicant's acknowledged duty of candor in disclosing information that may be relevant to the examination of claims to the present apparatus. However, it is respectfully submitted that none of the above-indicated patents disclose, teach, suggest, show, or otherwise render obvious, either singly or when considered in combination, the apparatus described and claimed herein.

SUMMARY OF THE APPARATUS

It is therefore an object of the present invention/apparatus to provide an improved height adjustable support tray apparatus to provide a portable working surface.

As presented in the exemplary configurations herein, the height adjustable support tray apparatus is configured for attachment to a support structure (also referred to herein as a support item) such as a portable luggage item.

It is understood that the height adjustable support tray apparatus of the instant apparatus can be attached to a wide variety of support items or support structures—including fixed or mobile items. For example the instant apparatus can be attached to a wall, bed, post, rail, vehicle, suitcase, luggage, site equipment, similar apparatus as the instant apparatus, a temporary support structure, or even a moving support structure.

Particularly the instant apparatus includes a unique attaching section which securely attaches the instant apparatus to the selected support structure.

The instant apparatus, when attached to the applicable support structure, provides a broadly useable working surface on which to support various items.

The instant apparatus includes a variety of repositioning elements thereby allowing users a multitude of adjustments of the angle and position of the working surface.

The instant apparatus also includes support elements which greatly increase the load carrying capacity of the working surface over minimally supported or non-supported working services such as some of the inventions disclosed in the foregoing patents.

Importantly, the instant invention is configured for portability and as disclosed herein, the instant invention can be stored and transported within an item such as a luggage item. When needed, the instant invention can be attached to that same transporting item to provide a working surface. Using the instant invention, this portable working surface can benefit from the support provided by, for example, the luggage item (or other support item) as well as the support provided by support elements of the instant invention.

Further, it is understood a variety of components and accessories can be further attached to the instant invention including electrical accessories, user specific work tools, work specific user tools, as well as interconnecting components for attaching a plurality of height adjustable support tray apparatus or similar items together.

Other novel features which are characteristic of the apparatus, as to organization and method of operation, together with further objects and advantages thereof will be better understood from the following description considered in connection with the accompanying figures, in which preferred embodiments of the apparatus are illustrated by way of example. It is to be expressly understood, however, that the figures are for illustration and description only and is not intended as a definition of the limits of the apparatus. The various features of novelty which characterize the apparatus are pointed out with particularity in the claims annexed to and forming part of this disclosure. The apparatus resides not in any one of these features taken alone, but rather in the particular combination of all of its structures for the functions specified.

There has thus been broadly outlined the more important features of the apparatus in order that the detailed description thereof that follows may be better understood, and in order that the present contribution to the art may be better appreciated. There are, of course, additional features of the apparatus that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present apparatus. It is important, therefore, that the claims be regarded as including such equivalent constructions insofar as they do not depart from the spirit and scope of the present apparatus.

Further, the purpose of the Abstract is to enable the national patent office (s) and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the apparatus of this application, which is measured by the claims, nor is it intended to be limiting as to the scope of the apparatus in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The apparatus will be better understood and objects other than those set forth above will become apparent when consideration is given to the following detailed description thereof. Such description makes reference to the annexed drawings, wherein.

DETAILED DESCRIPTION OF THE EMBODIMENTS

Figure 1A:
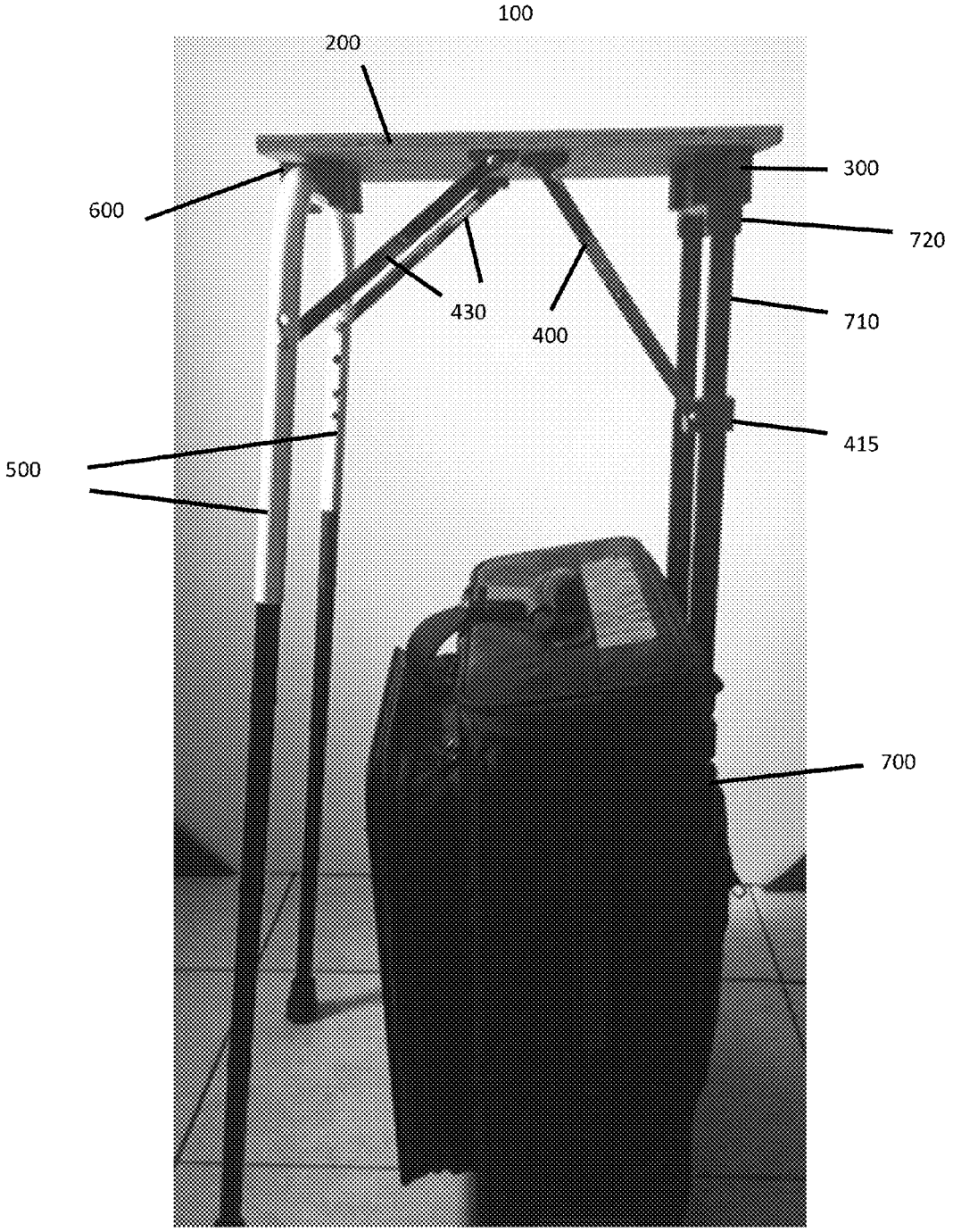
FIG. 1A is a perspective view of the height adjustable support tray apparatus.

As described below, the multiplicity of adjustable and pivotal features work in conjunction with each other to maximize the unique functionality of the instant apparatus.

While the preferred height adjustable support tray apparatus is presented herein, it is understood alternate embodiments may encompass trays differently configured as generally used within the applicable industry or by the specific user.

Generally the instant apparatus presents a height adjustable support tray apparatus 100 which is attachable to a support item 700 such as a luggage item 705. The height adjustable support tray apparatus 100 includes at least a support platform 200, an attaching section 300, and support legs 500. The height adjustable support tray apparatus 100 and further include, inter alia, at least one support brace 400.

With reference to FIGS. 1A-1E, and 2-5 the exemplary, but non-limiting usage of the height adjustable support tray apparatus 100 is shown wherein the support item 700 is a luggage item 705 which includes a luggage handle 720.

As will be explained below, the height adjustable support tray apparatus 100 generally operates in a non-use, stored, or folded position wherein the apparatus 100 is unattached to the support item and an in-use position wherein the apparatus 100 is attached at least partially to the support item.

Support Platform

As shown at least in FIGS. 1A-1D, the height adjustable support tray apparatus' support platform 200 includes a top side 201, a bottom side 202, an attachment edge 203, and a support edge 204 distal from the attachment edge 203. Top side 201 is generally a flat firm surface for supporting devices such as computers, work equipment, a printer, computer/programmer accessories such as a wand, mouse, keyboard, and various other items including nuts, bolts, screws, needles, syringes, etc. Alternatively top side 201 (and any area of the support platform 200) can be made of flexible or supple material such as a padded, or malleable cover made of plastic, leather, or other known materials. Further, while not shown, it is anticipated that the top side 201 (and any area of the support platform 200) may be shaped or formed into a variety of patterns and may include elements such as ridges, protrusions, channels, and openings.

Additionally while possibly not shown, it is anticipated any area of the height adjustable support tray apparatus 100 may be complemented with attaching devices, components, or structures such as an accessory tray (not shown) or shelf (not shown) positioned above or below the support platform 200.

Attaching Section

The attaching section 300 is positioned on the support platform bottom side 202 proximal to the attachment edge 203. The attaching section 300 includes at least one attachment section clamp 305 and at least one attachment section stop 310.

Preferably, the attachment section includes a pair of clamps 305 and a pair of stops 310 as shown in FIGS. 2-5.

Each attaching section clamp 305 is generally a channel or C-shaped formed to securely hold items positioned within the clamp 305. Each clamp 305 may be made from a variety of known materials including rubber, metal, or plastic, as well as from any suitable combination of materials. Each clamp 305 shape may include a single or plurality of shaped portions suitable for clamping, grasping, holding, or supporting items positioned within the clamp 305.

Each attaching section clamp 305 is sized to allow movement (sliding and/or rotation) as needed with respect to the support item 700. For example, the luggage handle 720 may slide or rotate while held within the clamp 305 as the handle 720 is raised or lowered.

Each attachment section stop 310 is preferably a rectangular block-shape formed to securely abut items positioned within an attaching section clamp 305.

In the preferred embodiment as shown in FIGS. 2-5 the attachment section stops 310 are repositionably attached to the support platform bottom side 202. By being repostionable a stop 310 can be positioned, such as by rotation, to abut a support item 700 positioned within an attaching section clamp 305 and thereby helps securely hold and inhibit lateral movement of the support item 700. Alternatively a stop 310 can be positioned, such as by rotation, to not abut a support item 700 positioned within an attaching section clamp 305 and thereby not interfere with movement of the support item 700. The repostionable movement of each stop 310 can be provided by pivotally, slideably, or rotationally attaching the stop 310 to the support platform bottom side 202 such as with a pin, bolt, slot, clamp, or other known fastening method.

Each stop 310 may be fixedly or removeably attached to the support platform bottom side 202. Where unneeded stop(s) 310 can be omitted or removed.

Exemplary Usage of Attaching Section

Figure 1B:
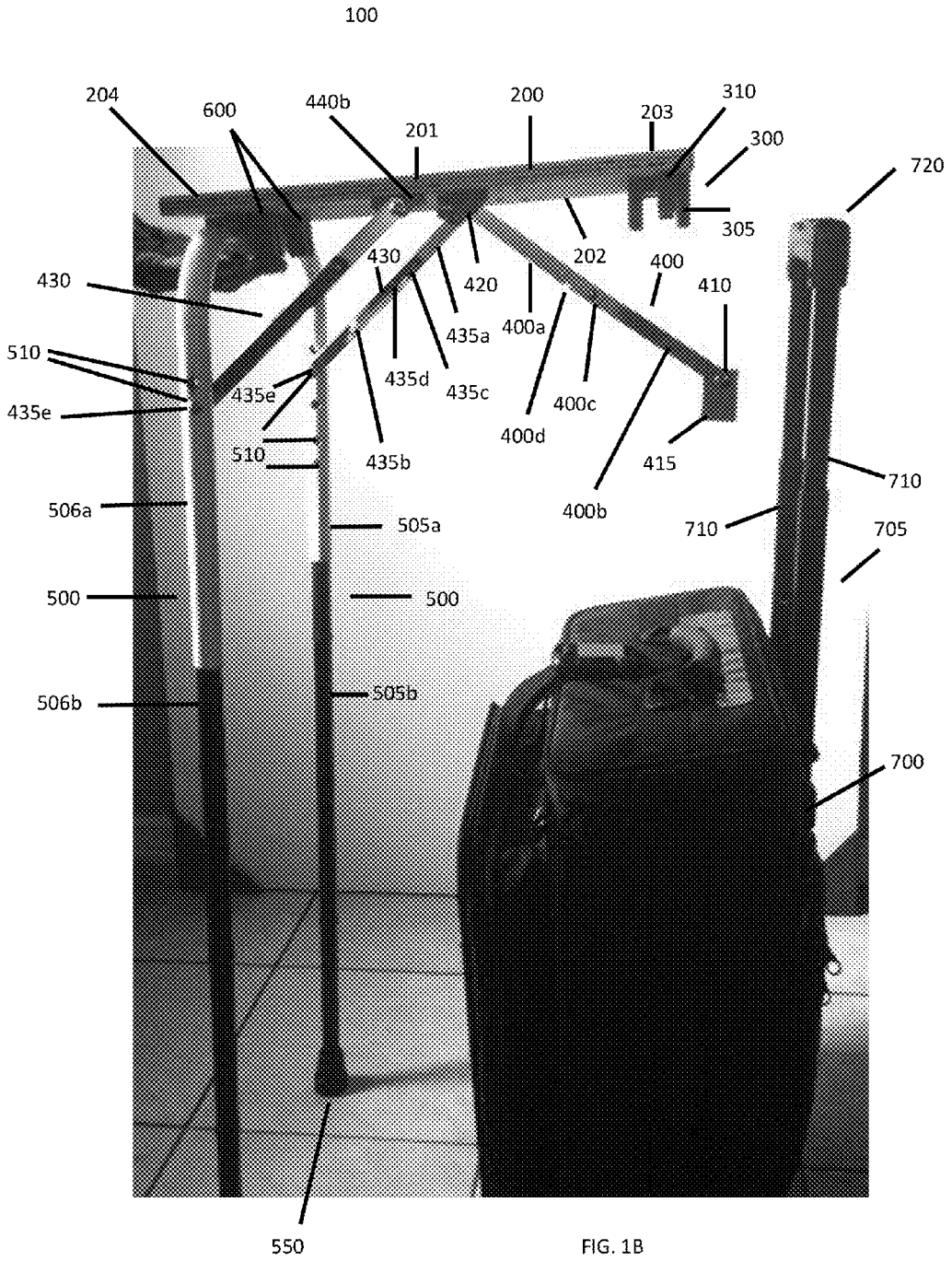
FIG. 1B is a perspective view of the height adjustable support tray apparatus.
Figure 1C:
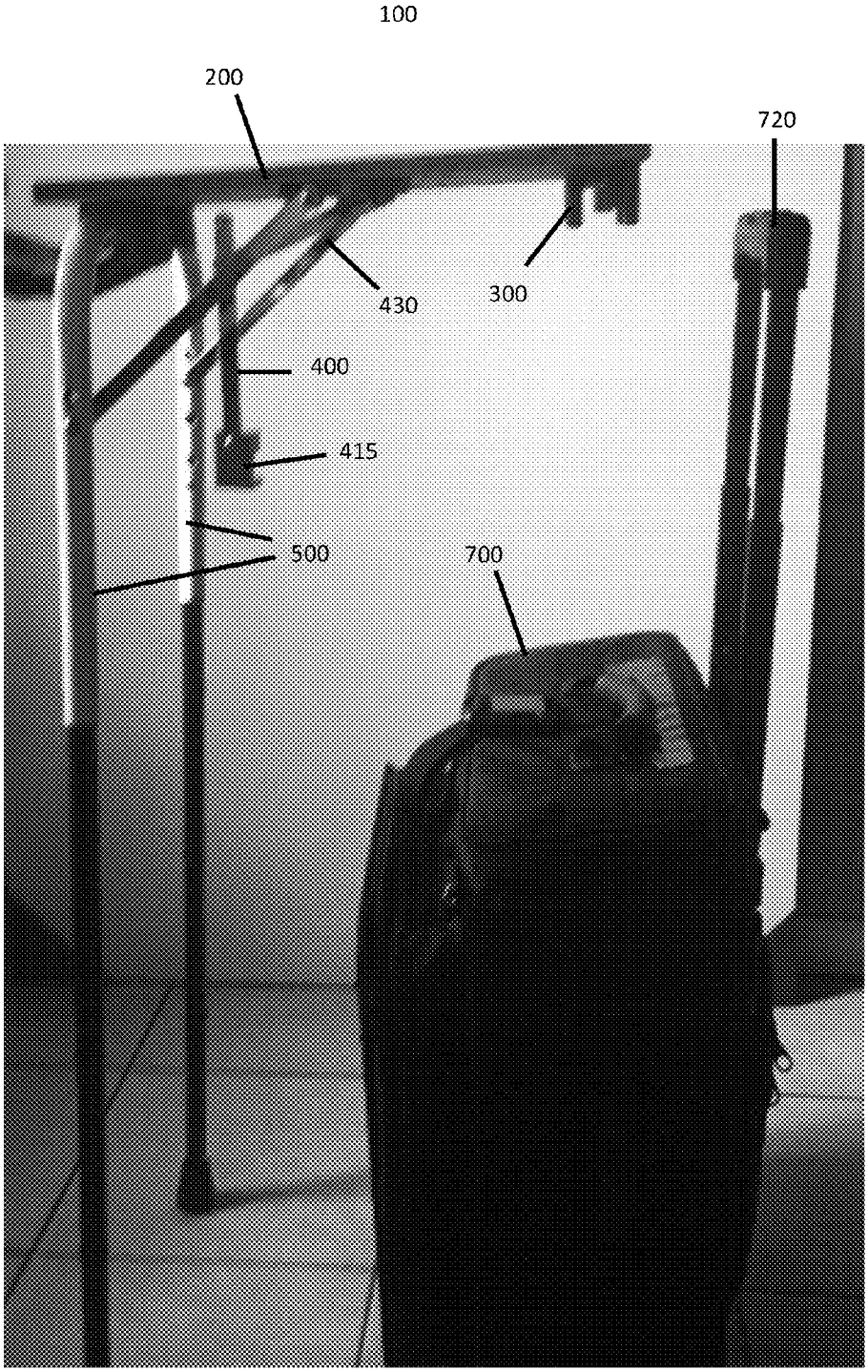
FIG. 1C is a perspective view of the height adjustable support tray apparatus.
Figure 1D:
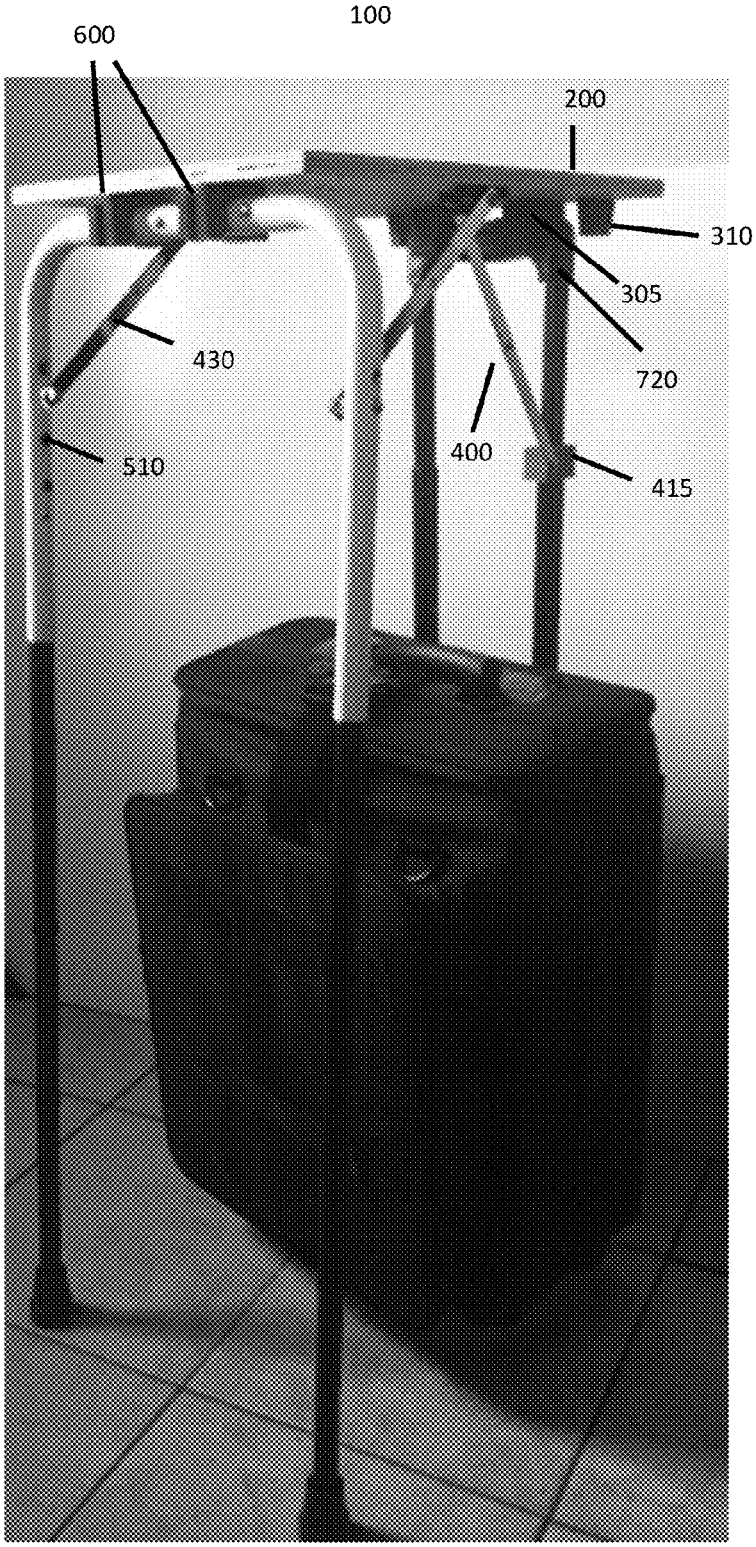
FIG. 1D is a perspective view of the height adjustable support tray apparatus.
Figure 1E:
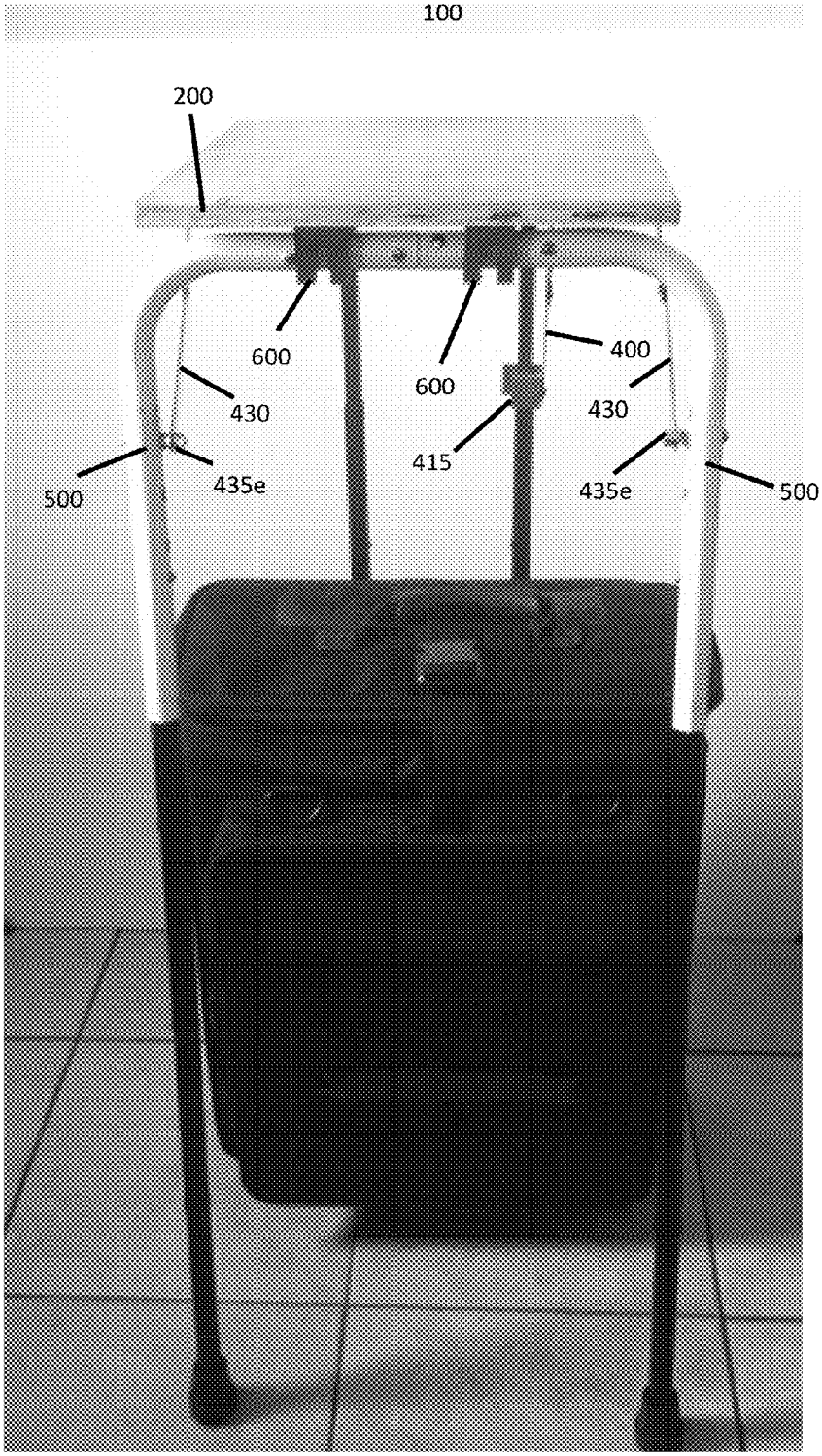
FIG. 1E is a perspective view of the height adjustable support tray apparatus.

When the height adjustable support tray apparatus is in the in-use position, as shown in the exemplary, but non-limiting usage of FIGS. 1A and 1D, the attaching section 300 is positioned on a portion of the support item 700.

When the height adjustable support tray apparatus 100 is in the non-use position, as shown in the exemplary, but non-limiting usage of FIGS. 1B, and 1C, the attaching section 300 is not positioned on a portion of the support item 700.

As shown in FIG. 1A, in the in-use position the attaching section clamp 305 is positioned atop the luggage handle 720 (any other similar support item 700 may be positioned here) and at least one attachment section stop 310 abuts the luggage handle 720 (or other similar support item 700) to inhibit lateral movement of the support item 700 while within the attaching section clamp 305. As shown in FIG. 2-5 at least one additional attachment section stop 310 is preferably provided to further inhibit lateral movement of the support item 700 while within the attaching section clamp 305. The attachment section stops 310 can be selectively repositioned away from the support item 700 as needed to free up movement of the support item 700.

Support Brace

The at least one support brace 400, as shown in FIGS. 1A-5 is positioned on the support platform bottom side 202 approximately midway between the attachment edge 203 and the support edge 204. It is envisioned that the support brace 400 could be positioned anywhere on the support platform 200 including the top side 201 as well as along any side edge of the support platform 200.

The support brace 400 is optionally provided to interconnect the support platform 200 with the support item 700 and provide sturdier support. As shown in the exemplary, but non-limiting usage of FIG. 1A, the support brace 400 can be attached to support item 700 elements such as an arm 710 of luggage item 705.

The support brace 400 includes a brace first section 400*a* pivotally connected to a brace second section 400*b* by a pivot 400*c*. The pivot 400*c* allows the support brace first section 400*a* and the support brace second section 400*b* to rotate with respect to each other. The support brace 400 also includes a brace lock element 400*d* to secure the brace first section 400*a* and brace second section 400*b* in a locked position. In the preferred embodiment brace lock element 400*d* is a protrusion provided on either the brace first section 400*a* or brace second section 400*b* to seat the applicable other brace section when that brace section is rotated into the locked position. Alternatively the lock tab 400*d* may be a pin, clamp, wire, or other known locking mechanism.

The support brace 400 further includes a clincher 415 pivotally connected to the second section 400*b* by a hinge 410. Clincher 415 is generally C-shaped formed to securely hold items positioned within the clincher 415. The clincher 415 may be made from a variety of known materials including rubber, metal, or plastic, as well as from any suitable combination of appropriate materials. The clincher 415 shape may include a single or plurality of shaped portions suitable for clamping, grasping, holding, or supporting items positioned within the clincher 415 such as arm 710 of luggage item 705 as shown in FIG. 1A. Hinge 410 allows clincher 415 to rotate with respect to second section 400*b*.

The support brace first section 400*a* is pivotally connected on the support platform bottom side 202 by mount 420 which allows the support brace first section 400*a* (and thereby the entire support brace 400) to rotate with respect to the support platform bottom side 202. The support brace mount 420 may include a pin or bolt or other known mechanism fixedly or removeably provided to pivotally connect the support brace 400 to the support platform 200.

Figure 2:
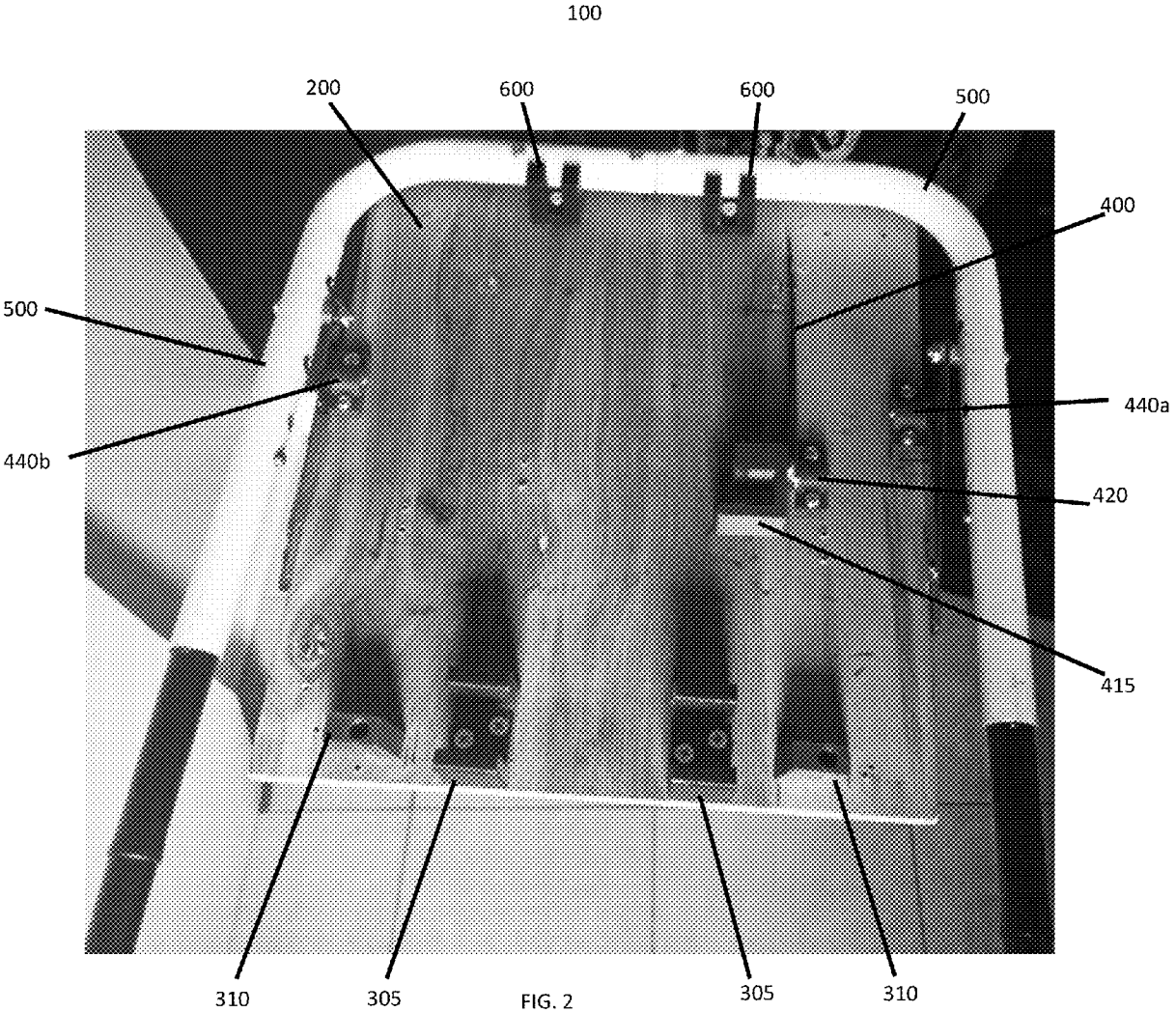
FIG. 2 is a bottom view of the height adjustable support tray apparatus.
Figure 3:
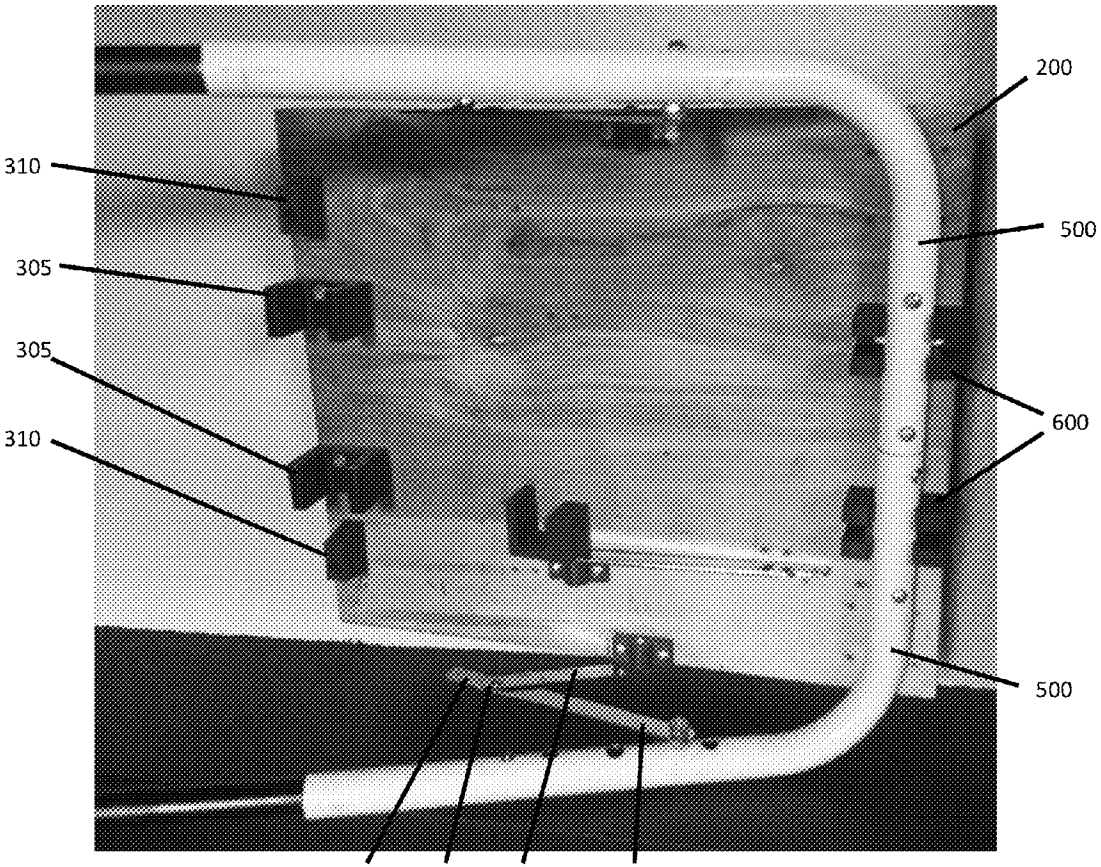
FIG. 3 is a bottom view of the height adjustable support tray apparatus.
Figure 4:
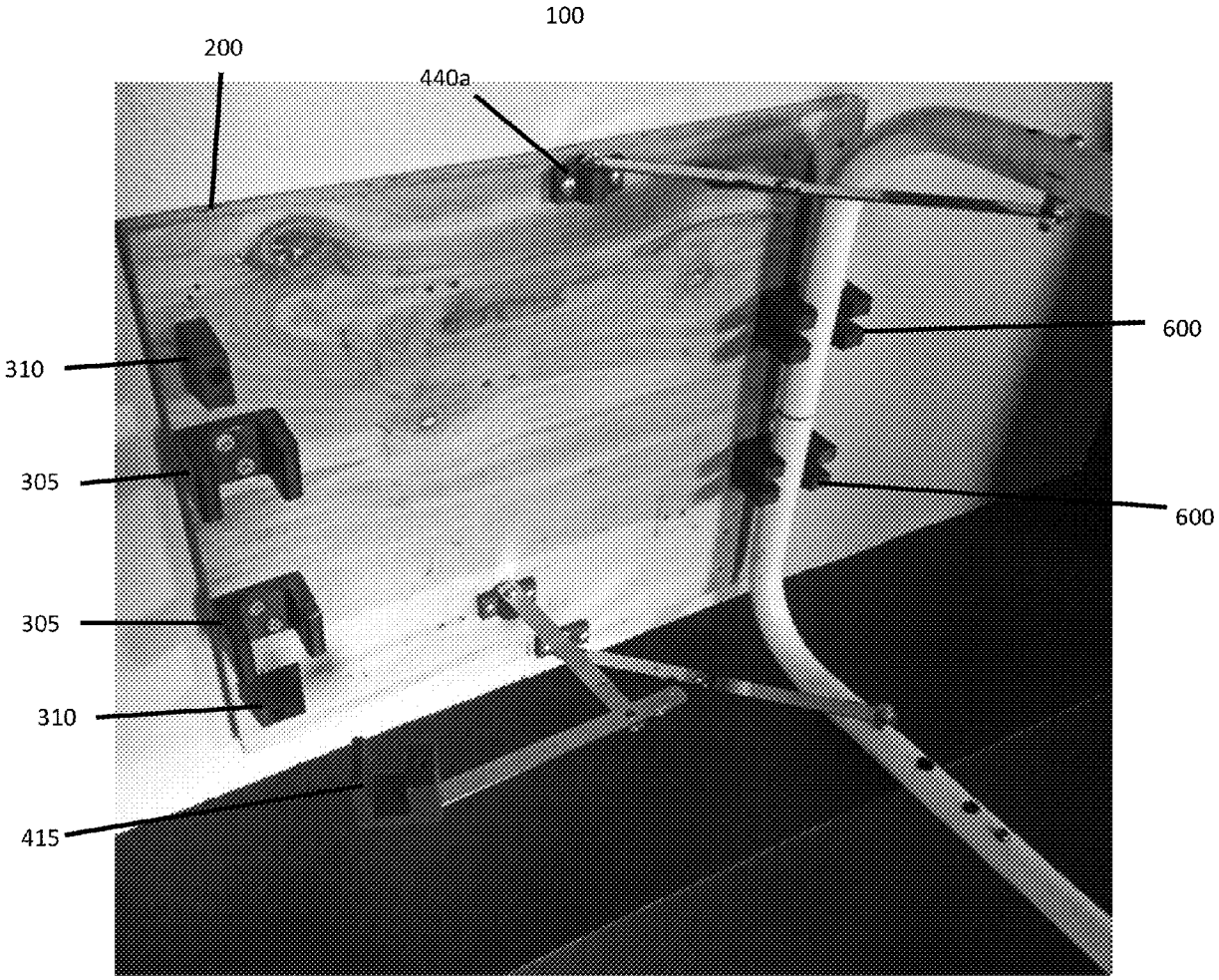
FIG. 4 is a bottom view of the height adjustable support tray apparatus.
Figure 5:
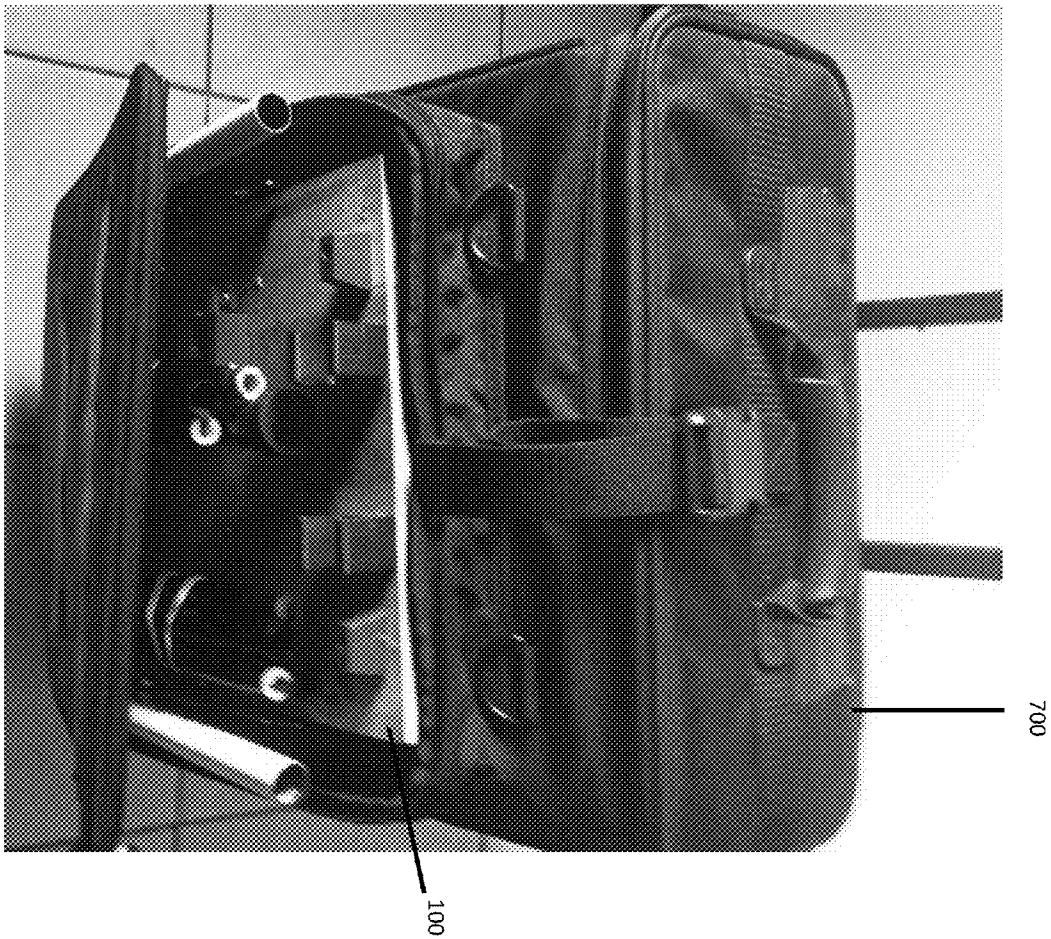
FIG. 5 is a perspective view of the tray apparatus stored in a luggage item.

As shown at least in FIGS. 1A-1B, and FIG. 2, the support brace 400 is fixedly or slidably attached to the support platform bottom side 202 via support brace mount 420. When the support brace 400 slidably attaches the support brace 400 to the platform 200 this allows the angle between the support brace first section 400*a* and second section 400*b* to variably adjust with respect to platform 200. When coupled with the variably extending length of the support leg(s) 500 the platform 200 can be readily repositioned by sliding the support brace mount 420 along the support platform 200 via applicable support brace mount 420 and/or via adjusting the length of the applicable support leg(s) 500. When slidably attached to the support platform bottom side 202, support brace mount 420 traverses a groove (not shown) or path (not shown) in the surface of the support platform bottom side 202 when the support brace mount 420 is loosened from the support platform bottom side 202 and remains in a fixed position within the groove or path when the support brace mount 420 is tightened against the support platform bottom side 202.

Support Leg(s)

At least one support leg 500 is pivotally attached to the support platform 200 approximate the support edge 203. Each support leg 500 is pivotally and removably fastened to the support platform bottom side 202 by a support clip 600. Support leg(s) 500 can be a fixed length or can include multiple leg segments such as first leg segment 506*a* and second leg segment 506*b* which may be fixedly or removably interconnected to each other. For example, first leg segment 506*a* may be telescopically connected to second leg segment 506*b*. Further either or both leg segments 506*a*, 506*b* may be telescopically, rotatably, or foldably extendable and include additional length segments.

As shown in the exemplary, but non-limiting usage of FIG. 1A-5, the height adjustable support tray apparatus 100 may include a pair of support legs 500 however it is envisioned the apparatus can have a single support leg 500.

Each support leg 500 may include footer 550 made from a variety of known materials including rubber, metal, or plastic, as well as from any suitable combination of appropriate materials. Each support leg 500, whether or not it includes the support leg footer 550, is provided to support the height adjustable support tray apparatus 100 on a variety of surfaces including a floor, bed frame, alternate structure, a portion of support item 700 (also referred to herein as a support structure), a wall, a tire, etc.

Each support leg 500 may be shaped the same or differently and may include for example a "Y" shape (not shown), amongst other configurations, wherein a pair of support clips 600 is provided on support platform bottom side 202, each having each support leg 500 wherein the pair of support legs are merged together to form a single support leg. Further, each support leg 500 may further include a supplemental leg extension (not shown) which provides an additional support to the height adjustable support tray apparatus 100 on a variety of surfaces. The supplemental leg extension may extend from a side of the support leg 500 or be positioned on or beneath the support leg 500 or support leg footer 550 or both.

Each support leg 500 is further connectable to the support platform bottom side 202 by a link 430 which includes a link first section 435*a*, a link second section 435*b*, a link lock element 435*c*, a link pivot 435*d*, and a link end nub 435*e* provided at an end of the link second section 435*b*.

Each link 430 is fixedly or slidably attached to the support platform bottom side 202 via a link mount 440*b*. Link mount 440*a* is essentially the same as link mount 440*b* and may be used in place of or in addition to link mount 430*b*. It is understood that further links 430 may employ additional link mounts as required. When the link mount 440*b* slidably attaches the support leg(s) 500 to the platform 200 this allows the angle between the support leg(s) 500 and the platform 200 to variably adjust. When coupled with the variably extending length of the support leg(s) 500 the platform 200 can be readily repositioned by sliding each link 430 along the support platform 200 via applicable link mount 440*b* and or via adjusting the length of the applicable support leg(s) 500. When slidably attached to the support platform bottom side 202, link mount 440*b* traverses a groove (not shown) or path (not shown) in the surface of the support platform bottom side 202 when the link mount 440*b* is loosened from the support platform bottom side 202 and remains in a fixed position within the groove or path when the link mount 440*b* is tightened against the support platform bottom side 202.

The link first section 435*a* is pivotally connected to the link second section 435*b* by link pivot 435*d*. Link pivot 435*d* allows the link first section 435*a* and the link second section 435*b* to rotate with respect to each other. The link lock element 435*c* secures the link first section 435*a* and the link second section 435*b* together in a locked position. In the preferred embodiment link lock element 435*c* is a protrusion provided on either the link first section 435*a* or the link second section 435*b* to seat the applicable other link section when that link section is rotated into the locked position. Alternatively the link lock element 435*c* may be a pin, clamp, wire, or other known locking mechanism.

Each support leg 500 may include at least one hole 510 for removably receiving the link end nub 435*e* of the link second section 435*b*. A plurality of support leg holes 510 may be provided. In the in-use position of the height adjustable support tray apparatus 100, by inserting the link end nub 435*e* into a selected support leg hole 510 the support leg 500 is interconnected to the support platform 200 via support leg link 430 thereby providing a sturdy buttress for the support platform 200.

As shown in the exemplary, but non-limiting usage of FIG. 1B plurality of support leg holes 510 is be provided, some which extend through the leg segments 506*a*, 506*b* and some which do not. Note that when the link end nub 435*e* is inserted into the support leg holes 510 a portion of the link end nub 435*e* may extend through the leg segments 506*a*, 506*b*.

Each support leg clip 600 is generally C-shaped formed to securely hold items positioned within the clip 600. Each clip 600 may be made from a variety of known materials including rubber, metal, or plastic, as well as from any suitable combination of materials. Each clip 600 shape may include a single or plurality of shaped portions suitable for clamping, grasping, holding, or supporting items positioned within the clip 600.

Each clip 600 is sized to allow movement (sliding and/or rotation) as needed with respect to the applicable support leg 500. For example, as the handle 720 is raised or lowered or the support leg(s) 500 are raised, lowered, or rotated, the support leg(s) 500 can move within each clip 600 as applicable.

General Usage and Storing

When the height adjustable support tray apparatus is in the in-use position, as shown in the exemplary, but non-limiting usage of FIGS. 1A and 1D, the attaching section 300 is positioned on a portion of the support item 700, at least one support leg 500 is attached to the support platform 200, and each applicable link 430 is locked in place further interconnecting the each applicable leg 500 to the support platform 200. If desired the support brace 400 is optionally employed to interconnect the support platform 200 with the support item 700. Users can then safely position the height adjustable support tray apparatus 100 as needed.

Users can adjust the height of the support platform 200 by extending the applicable leg(s) 500 while also adjusting the height of the support item 700 such as by raising or lowering the height of the handle 720 of a luggage item 705.

When the height adjustable support tray apparatus 100 is in the non-use position, the leg(s) 500 are disconnected from the support platform 200 and the link(s) 430 as well as the support brace 400 are folded down against the support platform bottom 202 thereby providing a compact apparatus 100 which can be stored within a section of the luggage item 705 along with any leg(s) 500 or put unobtrusively away.

Exemplary Configuration

In an exemplary configuration a height adjustable support tray apparatus is provided for support by a supporting structure having a handle portion, the apparatus comprising: a support platform having a top side, a bottom side, an attachment edge, and a support edge; an attachment section positioned on the support platform bottom side approximate the attachment edge; at least one support brace positioned on the support platform bottom side, the at least one support brace interconnecting the support platform bottom side with the supporting structure; and at least one support leg pivotally attached to the support platform approximate the support edge.

Additionally, as relates to the above exemplary configuration, wherein the supporting structure further includes at least one handle pole extending from the supporting structure handle portion: in an in-use position of the tray apparatus, the at least one attachment section is positioned over the supporting structure handle portion; the at least one support brace is positioned on the supporting structure at least one handle pole; and the at least one support leg extends to a supporting surface.

Additionally, as relates to the above exemplary configuration, wherein the attachment section includes at least one attachment channel for seating the supporting structure handle portion, and the attachment section further includes at least one securing block for releasably abutting the supporting structure handle portion when seated in the attachment section, wherein in the in-use position the at least one securing block abuts the handle portion to inhibit movement of the handle portion when seated in the attachment section, and wherein in a non-use position the at least one securing block does not abut the handle portion.

Additional Exemplary Configuration

In an additional exemplary configuration a height adjustable support tray apparatus is provided for support by a supporting structure having a handle portion and at least one handle pole extending from the handle portion, the tray apparatus comprising: a support platform having a top side, a bottom side, an attachment edge, and a support edge; at least one support leg removably and pivotally attached to the support platform approximate the support edge; an attachment section positioned on the support platform bottom side approximate the attachment edge, the attachment section including at least one attachment channel for seating the supporting structure handle portion, said attachment section including at least one securing block for releasably abutting the supporting structure handle portion; a respositionable support brace mount attaching an at least one support brace to the support platform bottom side, the at least one support brace interconnecting the support platform bottom side with the supporting structure, wherein the respositionable support brace mount allows the at least one support brace to variably adjust its position with respect to the support platform bottom side; a respositionable link mount which removably, pivotally, and repositionally attaches each the at least one support leg to the support platform bottom, wherein the respositionable link mount allows the at least one support leg to variably adjust its position with respect to the support platform bottom side; wherein in an in-use position: the at least one attachment section is positioned over the supporting structure handle portion; the at least one support brace is positioned on the supporting structure at least one handle pole; the at least one support leg extends to a supporting surface; the at least one securing block abuts the supporting structure handle portion to inhibit movement of the supporting structure handle portion when seated in the attachment section, and wherein in a non-use position the at least one securing block does not abut the supporting structure handle portion.

The foregoing disclosure is sufficient to enable one having skill in the art to practice the apparatus without undue experimentation, and provides the best mode of practicing the apparatus presently contemplated by the inventor. While there is provided herein a full and complete disclosure of the preferred embodiments of this apparatus, it is not intended to limit the apparatus to the exact construction, dimensional relationships, and operation shown and described. Various modifications, alternative constructions, changes and equivalents will readily occur to those skilled in the art and may be employed, as suitable, without departing from the true spirit and scope of the apparatus. Such changes might involve alternative materials, components, structural arrangements, sizes, shapes, forms, functions, operational features or the like. Elements of the instant apparatus may be made from a variety of known materials including wood, rubber, metal, or plastic, as well as from any suitable combination of appropriate materials.

Accordingly, the proper scope of the present apparatus should be determined only by the broadest interpretation of the appended claims so as to encompass all such modifications as well as all relationships equivalent to those illustrated in the drawings and described in the specification.

What is claimed is:

1. A height adjustable support tray apparatus for support by a supporting structure having a handle portion, said apparatus comprising:

a support platform having a top side, a bottom side, an attachment edge, and a support edge;

an attachment section positioned on said support platform bottom side approximate said attachment edge;

at least one support brace positioned on said support platform bottom side, said at least one support brace interconnecting said support platform bottom side with said supporting structure; and at least one support leg pivotally attached to said support platform approximate said support edge;

wherein said supporting structure further includes at least one handle pole extending from said supporting structure handle portion;

in an in-use position of said tray apparatus, said at least one attachment section is positioned over said supporting structure handle portion;

said at least one support brace is positioned on said supporting structure at least one handle pole; and said at least one support leg extends to a supporting surface;

wherein said attachment section includes at least one attachment channel for seating said supporting structure handle portion, and said attachment section further includes at least one securing block rotatably attached to and rotatable about an axis parallel to said support platform bottom side and for releasably abutting said supporting structure handle portion when seated in said attachment section, wherein in said in-use position said at least one securing block is rotated about an axis parallel to said support platform bottom side to abut said handle portion to inhibit movement of said handle portion when seated in said attachment section, and wherein in a non-use position said at least one securing block is rotated about an axis parallel to said support platform bottom side to not abut said handle portion.

2. The apparatus of claim 1 further including:

a respositionable support brace mount attaching said support brace to said support platform bottom, wherein said respositionable support brace mount allows said support brace to variably adjust it's position with respect to said support platform bottom side.

3. The apparatus of claim 1 further including:

a respositionable link mount which pivotally attaches each said support leg to said support platform bottom, wherein said respositionable link mount allows said support leg to variably adjust it's position with respect to said support platform bottom side.

4. The apparatus of claim 3 wherein each respositionable link mount is repositionally attached to each applicable said at least one support leg.

5. The apparatus of claim 1 further including:

a respositionable support brace mount attaching said support brace to said support platform bottom, and a respositionable link mount which pivotally attaches each said support leg to said support platform bottom, wherein said respositionable support brace mount allows said support brace to variably adjust its position with respect to said support platform bottom side, and wherein said respositionable link mount allows said support leg to variably adjust its position with respect to said support platform bottom side.

6. The apparatus of claim 1 further including:

a respositionable support brace mount attaching said at least one support brace to said support platform bottom, and a respositionable link mount which pivotally attaches each said at least one support leg to said support platform bottom, wherein said respositionable support brace mount allows said at least one support brace to variably adjust its position with respect to said support platform bottom side, and wherein said respositionable link mount allows said at least one support leg to variably adjust its position with respect to said support platform bottom side.

7. The apparatus of claim 6 wherein each respositionable link mount is repositionally attached to each applicable said at least one support leg.

8. The apparatus of claim 1 wherein each at least one support leg is variable in length.

9. The apparatus of claim 8 wherein each respositionable link mount is repositionally attached to each applicable said at least one support leg.

10. A height adjustable support tray apparatus for support by a supporting structure having a handle portion and at least one handle pole extending from said handle portion, said tray apparatus comprising:

a support platform having a top side, a bottom side, an attachment edge, and a support edge;

at least one support leg removably and pivotally attached to said support platform approximate said support edge;

an attachment section positioned on said support platform bottom side approximate said attachment edge, said attachment section including at least one attachment channel for seating said supporting structure handle portion, and at least one securing block rotatably attached to and rotatable about an axis parallel to said support platform bottom side and for releasably abutting said supporting structure handle portion;

a respositionable support brace mount attaching an at least one support brace to said support platform bottom side, said at least one support brace interconnecting said support platform bottom side with said supporting structure, wherein said respositionable support brace mount allows said at least one support brace to variably adjust its position with respect to said support platform bottom side;

a respositionable link mount which removably, pivotally, and repositionally attaches each said at least one support leg to said support platform bottom, wherein said respositionable link mount allows said at least one support leg to variably adjust its position with respect to said support platform bottom side;

wherein in an in-use position:

said at least one attachment section is positioned over said supporting structure handle portion;

said at least one support brace is positioned on said supporting structure at least one handle pole;

said at least one support leg extends to a supporting surface;

said at least one securing block abuts said supporting structure handle portion to inhibit movement of said supporting structure handle portion when said at least one securing block is rotated about an axis parallel to said support platform bottom side to abut said supporting structure handle portion positioned within said attachment section, and wherein in a non-use position said at least one securing block is rotated about an axis parallel to said support platform bottom side to not abut said supporting structure handle portion.

* * * * *